US007266929B1

(12) United States Patent
Allred et al.

(10) Patent No.: US 7,266,929 B1
(45) Date of Patent: Sep. 11, 2007

(54) THRESHOLD AND DETACHABLE SEALING FIN

(75) Inventors: Philip Allred, Kernersville, NC (US); Bruce Procton, Greensboro, NC (US)

(73) Assignee: Endura Products, Inc., Colfax, NC (US)

( * ) Notice: Subject to any disclaimer, the term of this patent is extended or adjusted under 35 U.S.C. 154(b) by 671 days.

(21) Appl. No.: 10/683,027

(22) Filed: Oct. 10, 2003

(51) Int. Cl.
*E06B 1/04* (2006.01)
*E06B 3/00* (2006.01)
*E06B 1/70* (2006.01)

(52) U.S. Cl. ..... 52/211; 52/204.55; 52/212; 52/214; 49/467

(58) Field of Classification Search ..... 52/204.1, 52/716.1, 212, 179, 188, 177, 182, 211, 204.55, 52/213, 717.01, 656.5, 656.6, 204.5, 204.51, 52/204.62, 716.6, 717.05, 214; 49/504, 467, 49/468, 469, 472; 277/644, 647, 649, 641, 277/921

See application file for complete search history.

(56) References Cited

U.S. PATENT DOCUMENTS

| | | | | | |
|---|---|---|---|---|---|
| 960,489 | A | * | 6/1910 | Braun | 52/179 |
| 2,722,724 | A | | 11/1955 | Miller | 20/64 |
| 2,848,766 | A | * | 8/1958 | Fulton | 49/469 |
| 2,999,280 | A | | 9/1961 | Miller | 20/64 |
| 3,032,837 | A | | 5/1962 | Ramsey | 20/16 |
| 3,079,652 | A | | 3/1963 | Wahlfeld | 20/64 |
| 3,382,617 | A | | 5/1968 | St. Aubin | 49/468 |
| 3,557,504 | A | * | 1/1971 | Graf | 52/179 |
| 3,762,100 | A | | 10/1973 | Kempel | 49/468 |
| 3,774,343 | A | | 11/1973 | Cribben et al. | 49/467 |
| 3,900,967 | A | | 8/1975 | Bursk et al. | 49/468 |
| 3,962,828 | A | * | 6/1976 | McAllister | 49/468 |
| 3,967,412 | A | | 7/1976 | Governale | 49/468 |
| 3,990,187 | A | | 11/1976 | Brown et al. | 49/467 |
| 4,055,917 | A | | 11/1977 | Coller | 49/469 |
| 4,079,550 | A | | 3/1978 | Bursk et al. | 49/467 |
| 4,213,275 | A | | 7/1980 | Oehmig | 49/468 |
| 4,237,664 | A | | 12/1980 | Wilmes | 52/209 |
| 4,310,991 | A | | 1/1982 | Seely | 49/470 |
| 4,352,258 | A | | 10/1982 | Bursk et al. | 49/468 |
| 4,387,535 | A | | 6/1983 | Corbo | 49/468 |
| 4,411,104 | A | | 10/1983 | St. Aubin | 49/470 |
| 4,413,446 | A | | 11/1983 | Dittrich | 49/470 |
| 4,430,830 | A | * | 2/1984 | Sailor | 52/211 |
| 4,447,987 | A | | 5/1984 | Lesosky | 49/468 |
| 4,578,905 | A | * | 4/1986 | Hout | 49/504 |
| 4,821,472 | A | * | 4/1989 | Tix | 52/204.55 |
| 4,945,680 | A | | 8/1990 | Giguere | 49/468 |
| 4,999,957 | A | * | 3/1991 | Kessler | 52/213 |
| 5,010,690 | A | | 4/1991 | Geoffrey | 49/468 |
| 5,119,609 | A | * | 6/1992 | Tait et al. | 52/213 |

(Continued)

FOREIGN PATENT DOCUMENTS

| | | | |
|---|---|---|---|
| CA | 667960 | 8/1963 | 108/70 |

*Primary Examiner*—Robert Canfield
*Assistant Examiner*—Ryan D Kwiecinski
(74) *Attorney, Agent, or Firm*—Jack B. Hicks; Womble, Carlyle, Sandridge & Rice, PLLC

(57) ABSTRACT

A threshold for installation atop a sub-sill of a building wall frame comprises a sill frame and a sealing fin including an upwardly extending upper panel substantially covering the entire forward edge of the sill frame. The sealing fin reduces moisture penetration and provides an attractive finished appearance.

27 Claims, 9 Drawing Sheets

U.S. PATENT DOCUMENTS

| | | | | |
|---|---|---|---|---|
| 5,136,814 | A | 8/1992 | Headrick | 49/468 |
| 5,230,181 | A | 7/1993 | Geoffrey et al. | 49/469 |
| 5,517,788 | A * | 5/1996 | McGough et al. | 49/468 |
| 5,553,419 | A | 9/1996 | Jenkins, II | 49/469 |
| 5,572,840 | A * | 11/1996 | Fast et al. | 52/213 |
| 5,590,496 | A * | 1/1997 | Martin et al. | 52/213 |
| 5,722,207 | A | 3/1998 | Anderson et al. | 52/204.55 |
| 5,768,837 | A | 6/1998 | Sjoeholm | 52/204.62 |
| 6,185,870 | B1 | 2/2001 | Mettler | 49/468 |
| 6,223,484 | B1 * | 5/2001 | Minter | 52/213 |
| 6,289,635 | B1 | 9/2001 | Procton et al. | 49/467 |
| 6,371,188 | B1 | 4/2002 | Baczuk et al. | 160/92 |
| 6,484,446 | B2 | 11/2002 | Young | 49/469 |
| 2003/0226320 | A1 * | 12/2003 | Engebretson | 52/204.5 |
| 2004/0139667 | A1 * | 7/2004 | Massey et al. | 52/204.1 |
| 2004/0211132 | A1 * | 10/2004 | Petta et al. | 52/204.1 |
| 2006/0096190 | A1 * | 5/2006 | Baczuk et al. | 52/204.1 |
| 2006/0150539 | A1 * | 7/2006 | Vanhastel et al. | 52/179 |

* cited by examiner

THRESHOLD AND DETACHABLE SEALING FIN

TECHNICAL FIELD

The invention relates to doors and, more particularly to threshold and doorsill assemblies for entryways and seals therefore.

BACKGROUND

Entryway systems used in building construction generally include a pair of vertically extending door jambs and a head jamb that frame the entryway and receive a hinged door. An elongated threshold assembly is attached at its ends to the bottoms of the door jambs and spans the bottom of the entryway atop a sub-sill and/or sub-floor. Many modern threshold assemblies include an extruded aluminum sill frame. These extruded frames often include an upwardly open channel from which a sill slopes outwardly and downwardly. A threshold cap, which may be made of plastic or wood, is disposed in the upwardly open channel and underlies a closed door mounted in the entryway. The threshold cap usually is vertically adjustable to meet and form a seal with a flexible seal attached to the bottom of the door.

Threshold assemblies are typically mounted atop a wooden or concrete sub-sill and/or sub-floor. The forward portions of the threshold assemblies often overhang a front face of the sub-sill and/or sub-floor and outwardly extend above an adjacent underlying structure such as sheathing, finished siding material or brick masonry. One important design parameter for threshold assemblies is to minimize if not eliminate intrusion of moisture under the front edges of the thresholds. Intruding water may damage an underlying wooden sub-floor and sub-sill.

In addition, the forward edges of extruded aluminum sill frames often are provided with functional yet unattractive configurations. For example, extruded sill frames may include one or more recesses, notches, grooves, or other features for optional mating engagement with extruded sill extensions or other attachments.

Accordingly, there is a need for a seal that reduces or eliminates the possibility of moisture reaching the wooden frame members underlying a threshold assembly, and also provides an attractive finished appearance to an irregularly shaped front edge of a doorsill.

SUMMARY

The invention includes a threshold for installation atop a sub-sill of a building wall frame having a front face. The threshold includes a sill frame with a sill deck having a forward deck portion and a forward edge. The forward deck portion and forward edge are configured to overhang the front face of the sub-sill by an overhang distance when the threshold is installed in the wall frame. A sealing fin is removably connected to the sill frame. The sealing fin includes an upwardly extending upper panel substantially covering the entire forward edge of the sill frame. The sealing fin further includes a downwardly extending lower panel that is inwardly offset from the upper panel by an offset distance that is substantially equal to the overhang distance. A web connects the upper and lower panels of the sealing fin.

The invention also includes a sealing fin for a door sill frame having a front edge. The sealing fin includes an upwardly extending upper panel having a lower edge. The upper panel is configured to engage in a mating fashion the front edge of the door sill frame, and to substantially cover the entire front edge of the door sill when the upper panel is engaged with the front edge. A substantially horizontal web rearwardly extends from the lower edge of the upper panel and has a rear edge. A lower panel downwardly extends from the rear edge of the web portion. The front edge of the door sill frame and the lower panel of the sealing fin are located a substantial distance behind the front edge of the sill frame when the upper edge of the upper is engaged with the front edge of the sill frame.

The invention further includes an entryway comprising a sub-sill having a top surface and a front face. A sill frame is mounted atop the top surface of the sub-sill, and includes a forward deck portion that overhangs the front face of the sub-sill, a front edge, and a bottom. A sealing fin has an upper panel substantially covering the entire front edge of the sill frame, a web portion rearwardly extending from the upper panel and underlying at least a portion of the bottom of the sill frame, and a lower panel downwardly extending from the web portion. The lower panel is closely proximate to the front face of the sub-sill and is affixed to the sub-sill by a plurality of fasteners. The fasteners can be removable or non-removable. The sealing fin provides a substantially water-resistant barrier between the sill frame and the sub-sill.

In addition, the invention includes a method of sealing a juncture between a sub-floor having a front edge and a door sill having a bottom and a forward edge overhanging the front edge of the sub-floor by a substantial distance. The method includes obtaining a one-piece moisture-resistant polymeric sealing fin having a first connecting means for connecting a front portion of the sealing fin to the front edge of the sill and a second connecting means for connecting a rear portion of the sealing fin to the front edge of the sub-floor. The method further includes connecting the first connecting means of the sealing fin to the forward edge of the sill, and connecting the second connecting means of the sealing fin to the front edge of the sub-floor such that the front portion of the sealing fin substantially covers the forward edge of the sill and the sealing fin substantially conforms to the juncture between the sub-floor and the sill.

DETAILED DESCRIPTION

Figure 1:
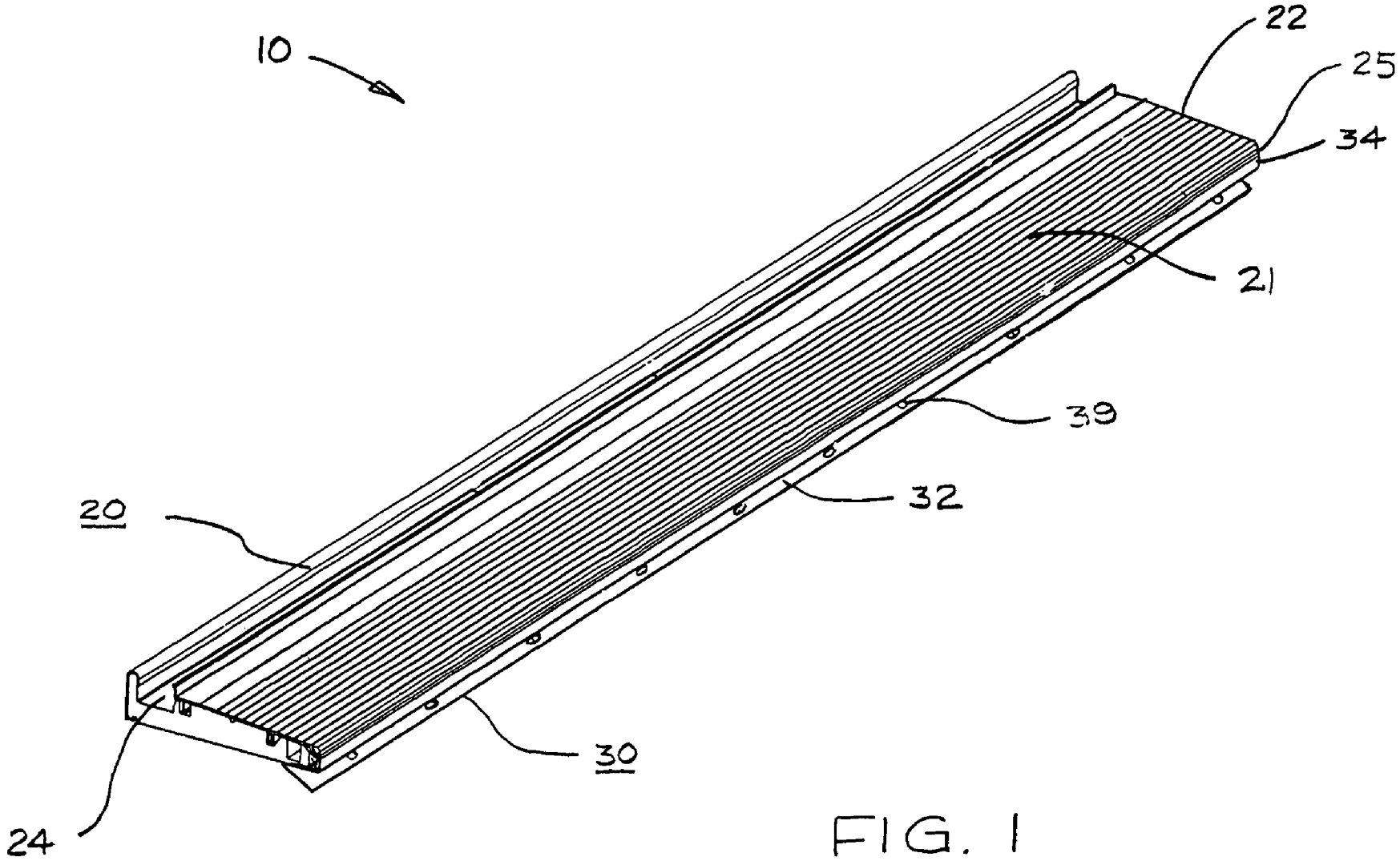
FIG. 1 is a perspective view of one embodiment of a threshold assembly according to the invention.

FIG. 1 shows an embodiment of an inswing doorsill or threshold assembly 10 with a detachable sealing fin 30 in accordance with the invention. The threshold assembly 10 includes a doorsill 20 having a sill frame 22 and an upwardly open threshold channel 24. The threshold channel 24 is configured to receive a threshold cap 70 like that shown in FIG. 5. The sill frame includes an outwardly extending sill deck 21. In a preferred embodiment, the sill deck 21 also is downwardly sloping. As shown in FIG. 1, the sealing fin 30 is affixed to the front edge 25 of the sill frame 22, and includes an upper panel 34 that substantially covers the entire front edge 25 of the doorsill 20. The sealing fin 30 also includes a downwardly extending lower panel 32 having a plurality of fastener openings 39 therein.

Figure 2:
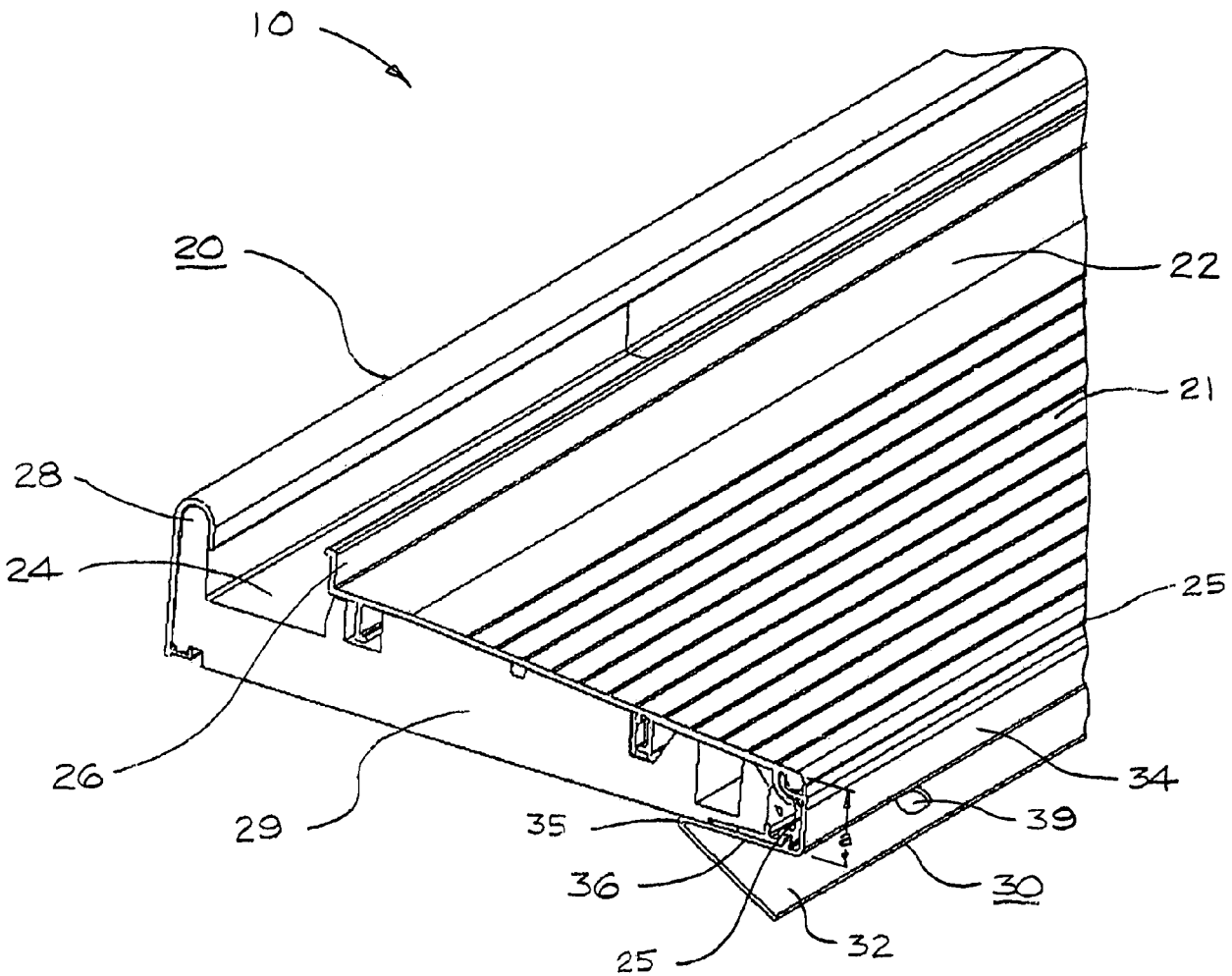
FIG. 2 is an enlarged perspective view of one end of the threshold assembly shown in FIG. 1.

As shown in FIG. 2, the threshold assembly 10 includes an outside dam 26 and a nosing piece 28 on opposed sides of the channel 24. Preferably, the sill frame 22 is extruded aluminum. A suitable substrate 29 underlies and supports the extruded sill frame 22. Suitable substrates include wood and rot-resistant synthetic materials. The front edge of the sill frame has a height "a" as shown in FIG. 2.

Figure 3:
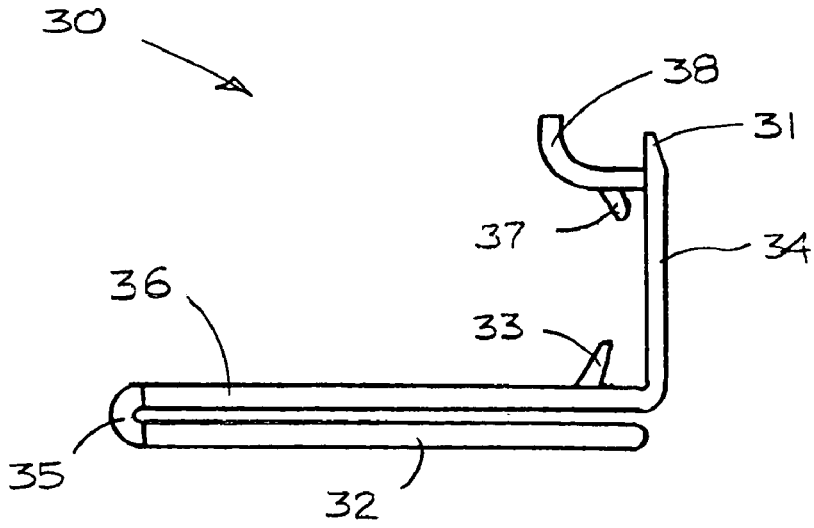
FIG. 3 is an end view of an embodiment of a sealing fin according to the invention with its lower panel in a first position.
Figure 4:
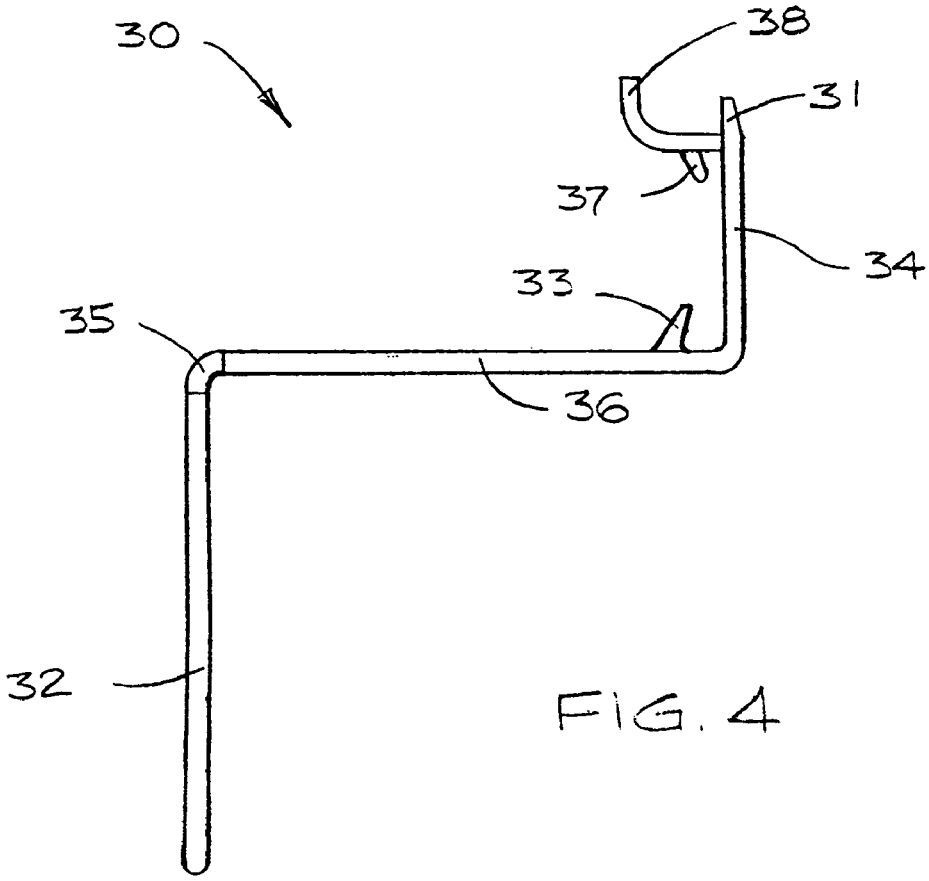
FIG. 4 is an end view of the sealing fin of FIG. 3 with the lower panel in a second position.
Figure 5:
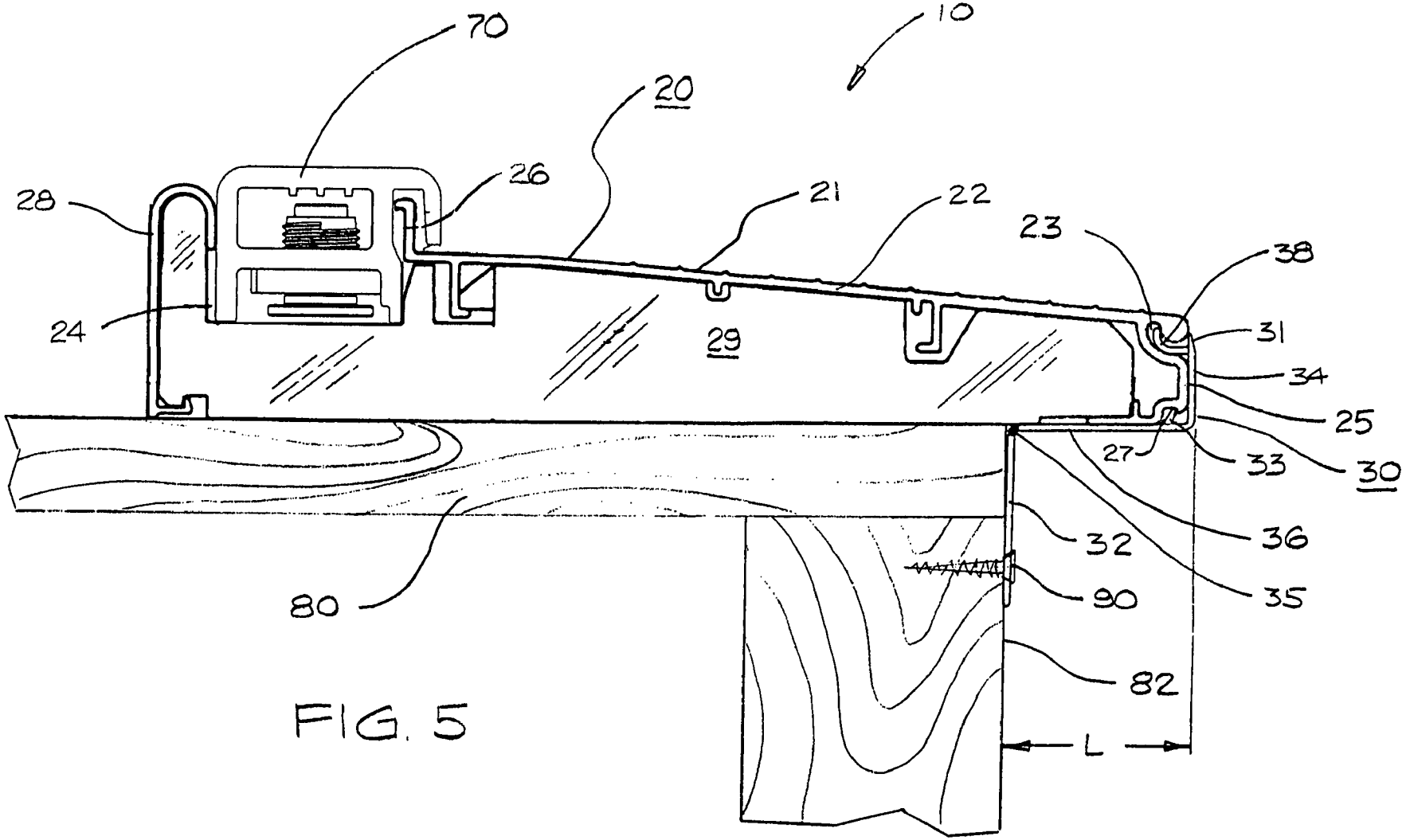
FIG. 5 is a cross sectional view of the threshold assembly of FIGS. 1 and 2 installed in an entryway.

A configuration for the detachable sealing fin 30 is shown in FIGS. 3 and 4. The sealing fin 30 is specifically configured to correspond to the shape and mating features of the matching sill frame 22. The sealing fin 30 includes a substantially planar upper panel 34 and a substantially planar lower panel 32. A substantially planar horizontal web 36 connects a lower edge of the upper panel 34 to an upper edge of the lower panel 32. The sealing fin 30 may include a flexible hinge portion 35 at the intersection between the web 36 and the lower panel 32. In a preferred embodiment, the flexible hinge portion 35 may be integral, i.e., formed with by co-extrusion or otherwise, the sealing fin 30. The hinge portion 35 permits the lower panel 32 to pivot between a first position (as shown in FIG. 3) and a second position (as shown in FIGS. 4 and 5). The lower panel of course may pivot to any desired position, and is not limited to the first or second position shown. Preferably, the lower panel 32 is in the first position in a relaxed state. Accordingly, the lower panel 32 is tucked in its first position prior to installation of the sealing fin 30 in an entryway, and can be downwardly pivoted into the second position during installation.

As shown in FIGS. 3 and 4, the upper edge 31 of the upper panel 34 may be tapered. An upwardly curved tongue 38 inwardly extends from the rear of the upper panel 34, and includes a downwardly depending tab or sealing lip 37. A catch 33 upwardly extends from the web 36.

Preferably, the sealing fin 30 is extruded in one piece from a non-metallic material. For example, the sealing fin 30 may be an extruded polymeric material such as polyvinyl chloride (PVC). In a preferred embodiment, the sealing fin 30 is extruded in a single piece, and comprises multiple co-extruded polymeric materials. For example, the upper panel 34, tongue 38, web 36, catch 33, and lower panel 32 may be a rigid PVC material, while the tab 37 and hinge portion 35 may be a co-extruded flexible PVC material. This combination of materials provides a durable sealing fin with select portions that are highly flexible. The sealing fin also may be formed of varying colors, to match surrounding environmental elements.

The threshold assembly 10 is shown in a typical installed configuration in FIG. 5. The threshold 10 is installed atop a sub-floor or sub-sill 80 in an entryway. A forward portion of the doorsill 20 overhangs a front face 82 of the sub-sill 80 by an overhang distance "L". In a typical installation, the overhanging front portion of the doorsill 20 is either free-hanging or further supported by brick masonry or other structure (not shown). The sealing fin 30 may be connected to the front edge 25 of the sill frame 22 in a variety of ways. Preferably, the connection is achieved by an inwardly protruding tongue 38. The tongue 38 extends inside an elongated recess 23 in the front edge 25 of the sill frame 22. The flexible sealing lip 37 on the bottom of the tongue 38 is wedged in the recess 23 and the upwardly curled tongue 38 interlocks in the recess 23 to securely retain the upper panel 34 of the sealing fin against the front edge of the sill frame 22. The upper edge 31 of the upper panel 34 covers the recess 23 in the sill frame 22, thereby providing the front edge 25 of the sill frame 22 with a finished appearance. The tapered upper edge 31 is held in close contact with the front edge 25 of the sill frame 22 by the engaged tongue 38, thereby making the upper edge 31 of the installed sealing fin 30 difficult to snag or crush. In a preferred connection, therefore, no tools or separate fasteners are required either to connect the sealing fin 30 to the sill frame 22, or to remove the sealing fin from the sill frame 22.

As shown in FIG. 5, the width of web 36 of the sealing fin 30 is substantially equal to the overhang distance "L". This permits the lower panel 32 to be closely proximate to the front face 82 of the sub-sill 80 in the second or installed position. The catch 33 on the web 36 engages a mating notch in the bottom of the sill frame 22. The catch 33 cooperates with the engaged tongue 38 to securely hold the upper panel 34 against the front edge 25 of the sill 20. The hinge portion 35 nests in the corner formed by the juncture between the substrate 29 of the doorsill 20 and the sub-floor 80. The lower panel is secured to the front face of the sub-floor 80 by a plurality of suitable fasteners 90 such as screws, nails, or staples. A plurality of spaced fastener openings 39 may be provided in the lower panel 32 for receiving the fasteners 90 (see FIGS. 1 and 2).

As shown in FIG. 5, the sealing fin 30 provides a substantially watertight seal at the juncture between the sill 20 and the sub-floor/sub-sill 80. The sealing fin 30 minimizes the amount of moisture that may seep past the sill 20 and reaching the wooden sub-floor/sub-sill 80. The upper panel 34 helps prevent water migration. The sealing lip 37 also helps substantially reduce or eliminate the water that may penetrate and eventually migrate to the sub-floor.

Figure 6:
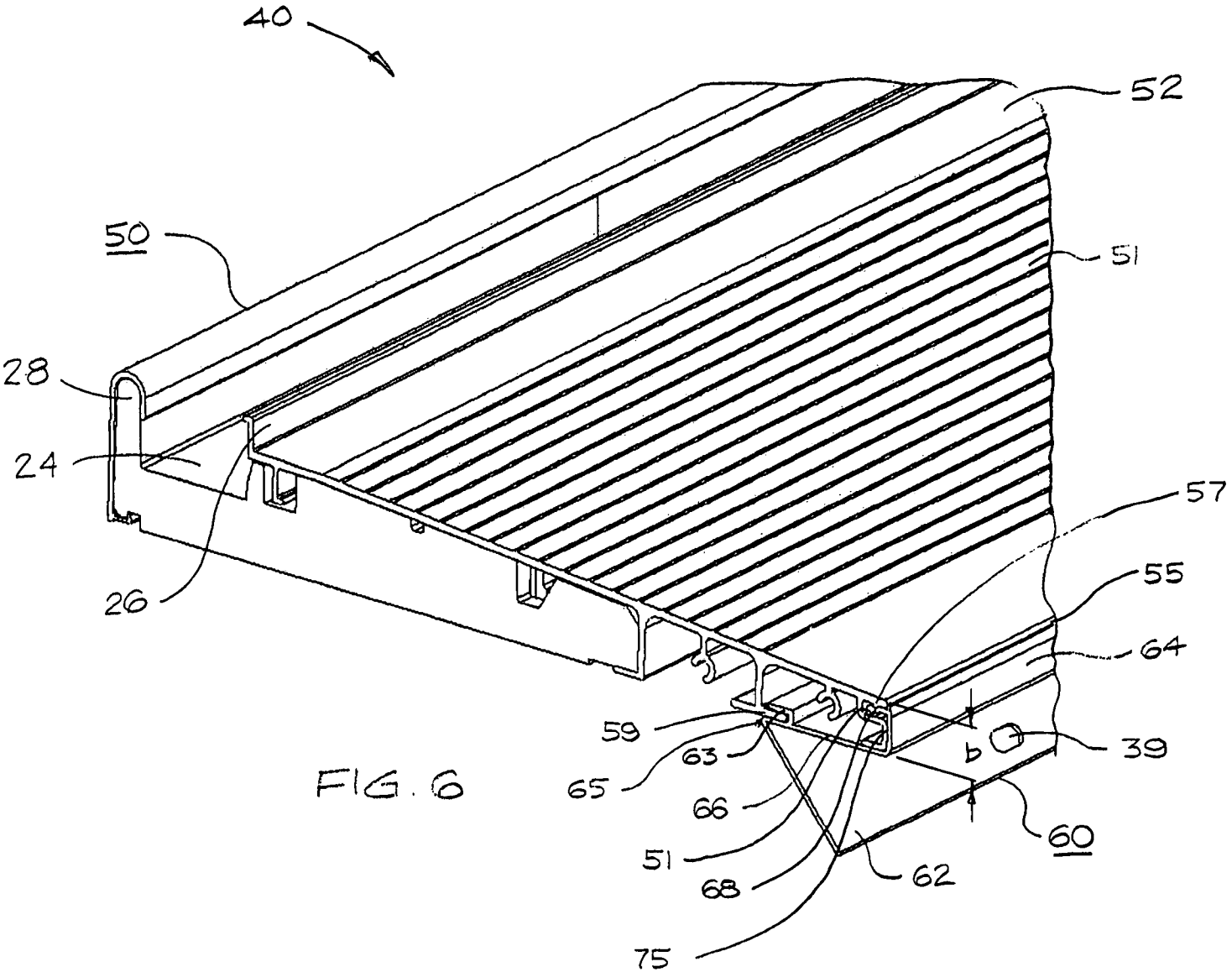
FIG. 6 is a perspective view of one end of a second embodiment of a threshold assembly according to the invention.
Figure 7:
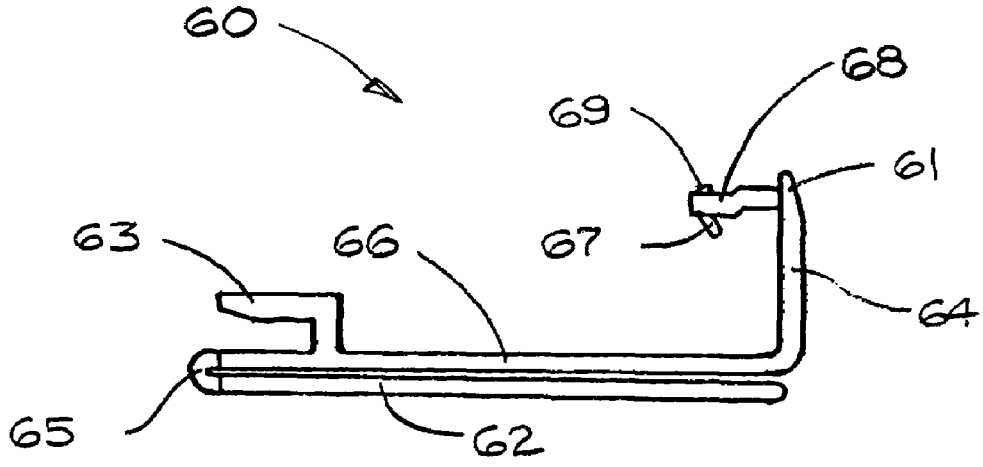
FIG. 7 is an end view of another embodiment of a sealing fin for use with the threshold of FIG. 6 with the lower panel of the sealing fin in a first position.
Figure 8:
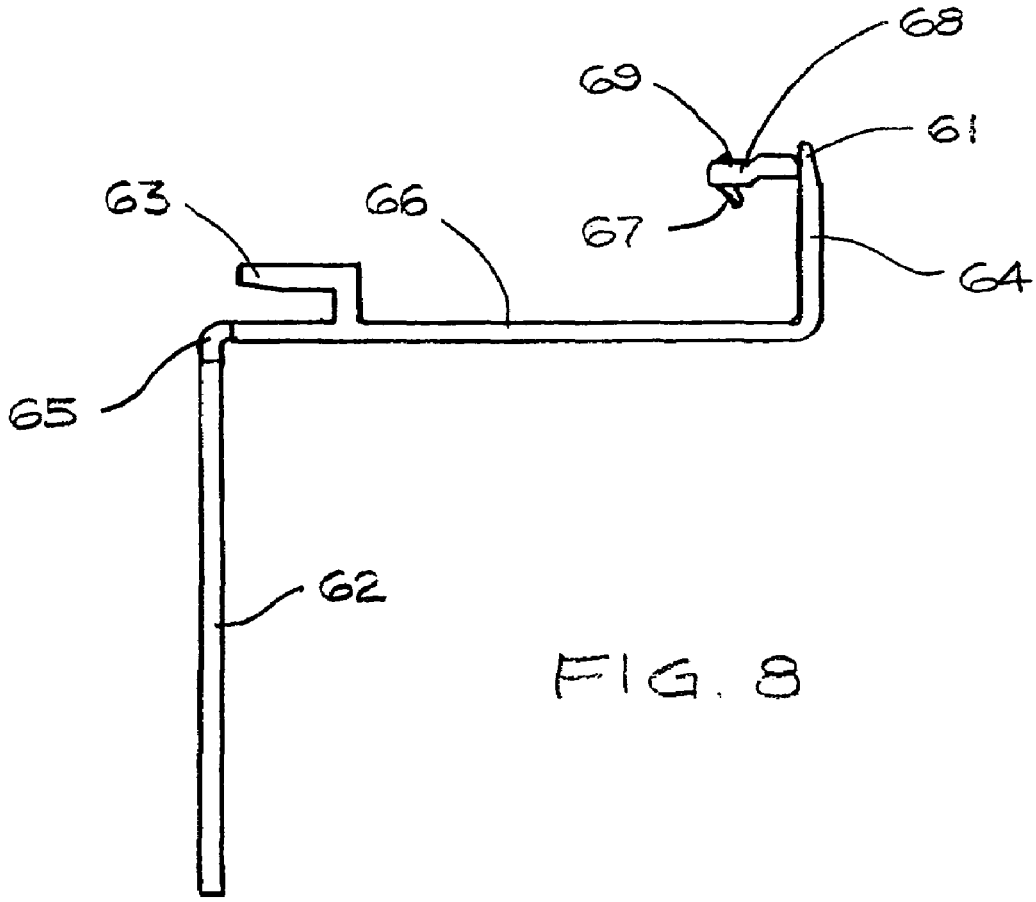
FIG. 8 is an end view of the sealing fin of FIG. 7 with the lower panel in a second.
Figure 9:
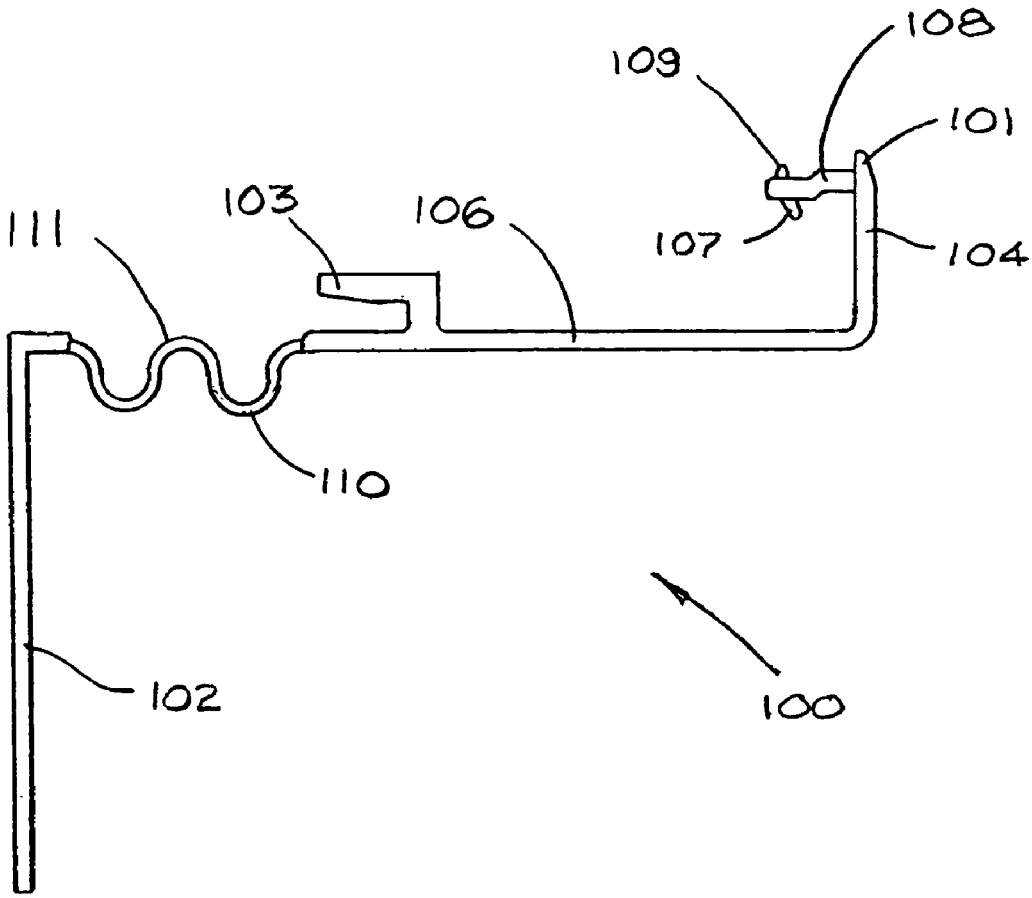
FIG. 9 is an end view of another embodiment of a sealing fin according to the invention.

An alternative sealing fin configuration 60 is shown in FIGS. 6-8. Though the sealing fin 60 is similar to the sealing fin 30 described above, this second embodiment 60 is configured to engage the front edge 75 of a deeper inswing threshold assembly 40 like that shown in FIG. 6. The longer downward slope of the sill deck 51 causes the front edge 75 to have a height "b" that is shorter than the height "a" of the front edge 25 of the threshold 10 (see FIG. 2). Accordingly, a different sealing fin 60 is required for the deeper threshold 40.

As shown in FIGS. 7 and 8, the sealing fin 60 includes a substantially planar upper panel 64 and a substantially planar lower panel 62. A substantially planar horizontal web 66 connects a lower edge of the upper panel 64 to an upper edge of the lower panel 62. The sealing fin 60 may include a flexible hinge portion 65 at the intersection between the web 66 and the lower panel 62. In a preferred embodiment, the flexible hinge portion 65 can be integral, i.e., formed with, the sealing fin 60. The hinge portion 65 permits the lower panel 62 to pivot between multiple positions, including a first position (as shown in FIG. 7) and a second position (as shown in FIGS. 6 and 8). The lower panel of course may pivot to any desired position, and is not limited to the first or second position shown. Preferably, the lower panel 62 is folded in a compact arrangement prior to final installation of the sealing fin 60 in an entryway, and can be downwardly pivoted into the second position during installation.

As shown in FIGS. 7 and 8, the upper edge 61 of the upper panel 64 may be tapered. A tongue 68 inwardly protrudes from the rear of the upper panel 64, and includes a downwardly depending tab or sealing lip 67. Sealing lip 67 functions similarly to sealing lip 37. A clip portion or hook 63 upwardly extends from the top surface of the web 66. Preferably, the upper panel 64, tongue 68, web 66, hook 63, and lower panel 62 are made of rigid or semi-rigid polyvinyl chloride (PVC), while the tab 67 and hinge portion 65 are made of a co-extruded, flexible PVC. This combination of materials provides a rigid or semi-rigid sealing fin with select portions that are highly flexible.

As shown in FIG. 6, the sealing fin is connected to the sill frame 52 by engaging the hook 63 onto a flange 59 on a lower portion of the sill frame 52, and by inserting the tongue 68 in an elongated recess 51 in the front edge 55 of the frame 52. The flexible tab 67 on the top of the tongue 67 (see FIGS. 7 and 8) is wedged in the recess 51, and the catch 69 on the top of the tongue 68 grabs a rib 57 protruding from the roof of the recess 51 (see FIG. 6). When installed in an entryway, the sealing fin 60 is closely proximate to the bottom of the sill and the front face 82 of the sub-floor 80 as shown in FIG. 5 for sealing fin 30.

Figure 10:
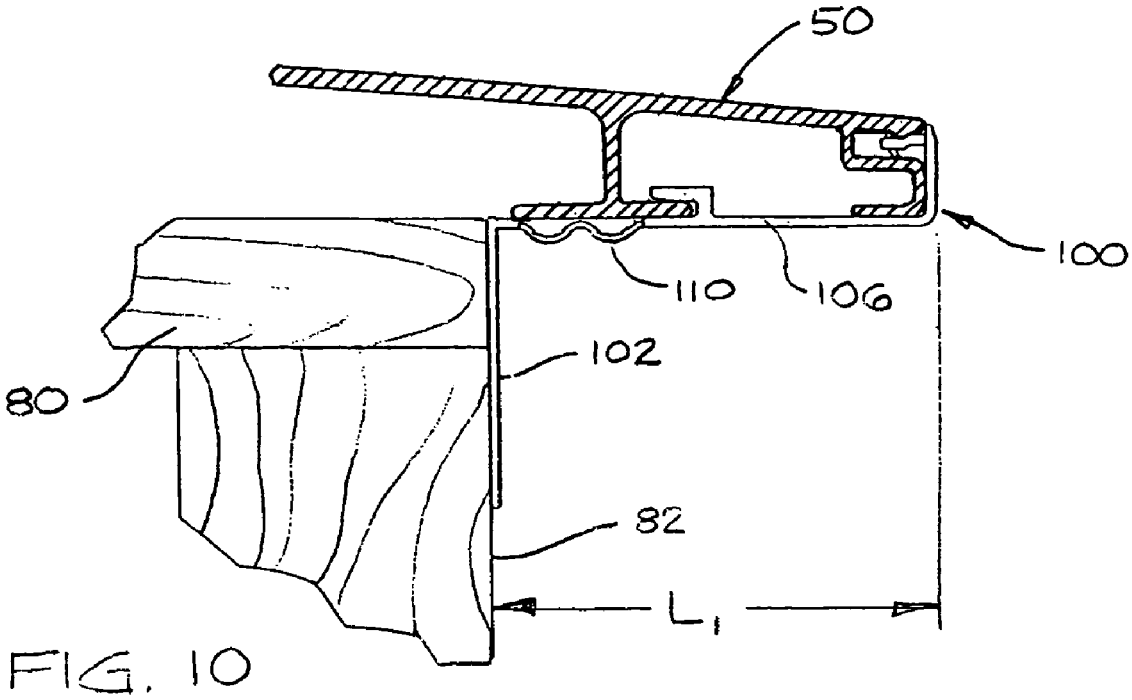
FIG. 10 is a cross sectional view of a threshold assembly installed in an entryway with the sealing fin of FIG. 9 conforming to an overhang distance $L_1$.
Figure 11:
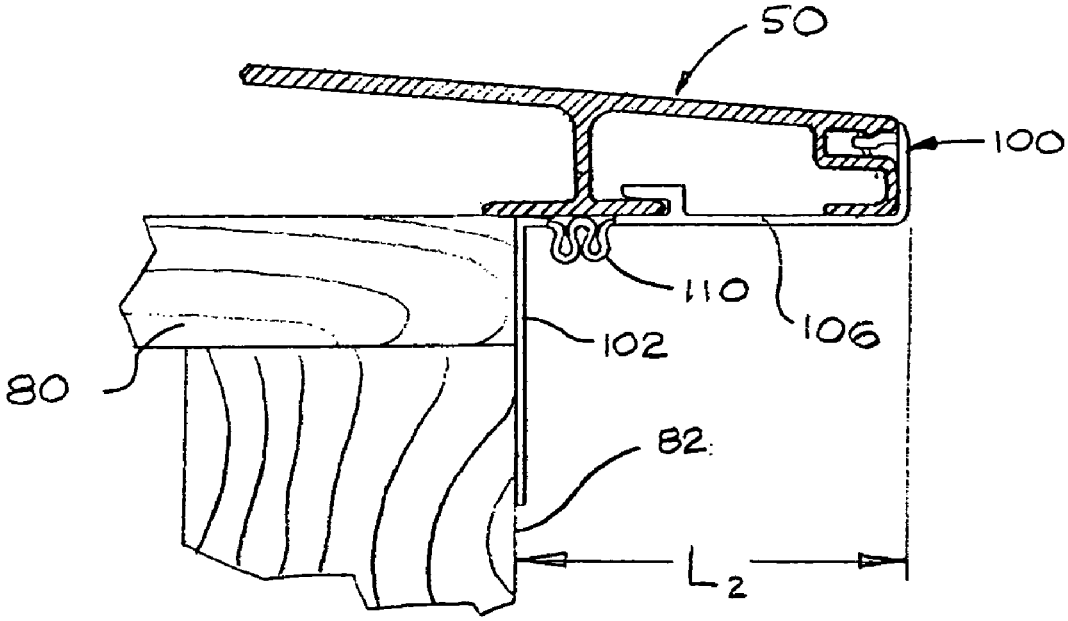
FIG. 11 is a cross sectional view of a threshold assembly installed in an entryway with the sealing fin of FIG. 9 conforming to an overhang distance $L_2$.

Another embodiment of a sealing fin 100 according to the invention is shown in FIGS. 9-12. The sealing fin 100 is similar to embodiments 30 and 60 described above, but the web portion 106 includes an extendable and contractable portion 110. The extendable and contractable portion 110 permits the horizontal distance between an upper panel 104 and a lower panel 102 of the sealing fin 100 to be selectively lengthened or shortened to accommodate variations in the overhang distance of a mating door sill. The extendable and contractable portion 110 preferably is constructed of a flexible material such as flexible PVC. In the embodiment shown in FIGS. 9-12, the extendable and contractable portion 110 has a corrugated or fanfold configuration including a series of folds 111. As shown in FIGS. 10 and 11, the sealing fin 100 can be used with a sill 50 that overhangs the outer face 82 of a sub-floor or sub-sill 80 by a long overhang distance "$L_1$", and can also be used with a sill 50 that overhangs the outer face 82 of a sub-floor or sub-sill 80 by a short overhang distance "$L_2$". In FIG. 10, the extendable and contractable portion 110 is stretched to permit the lower panel 102 to be flush with the outer face 82 of the sub-sill and/or sub-floor 80. In FIG. 11, the extendable and contractable portion 110 is compressed to permit the lower panel 102 to be flush with the outer face 82 of the sub-sill and/or sub-floor 80. Accordingly, the sealing fin 100 can be used with door sill installations that have variable sill overhang distances, while providing an effective moisture barrier between the sill 50 and sub-floor or sub-sill 80, 82. The sealing fin 100 can also be used in a door sill installation having a overhang distance that varies from one end of the sill 50 to the other end.

Figure 12:
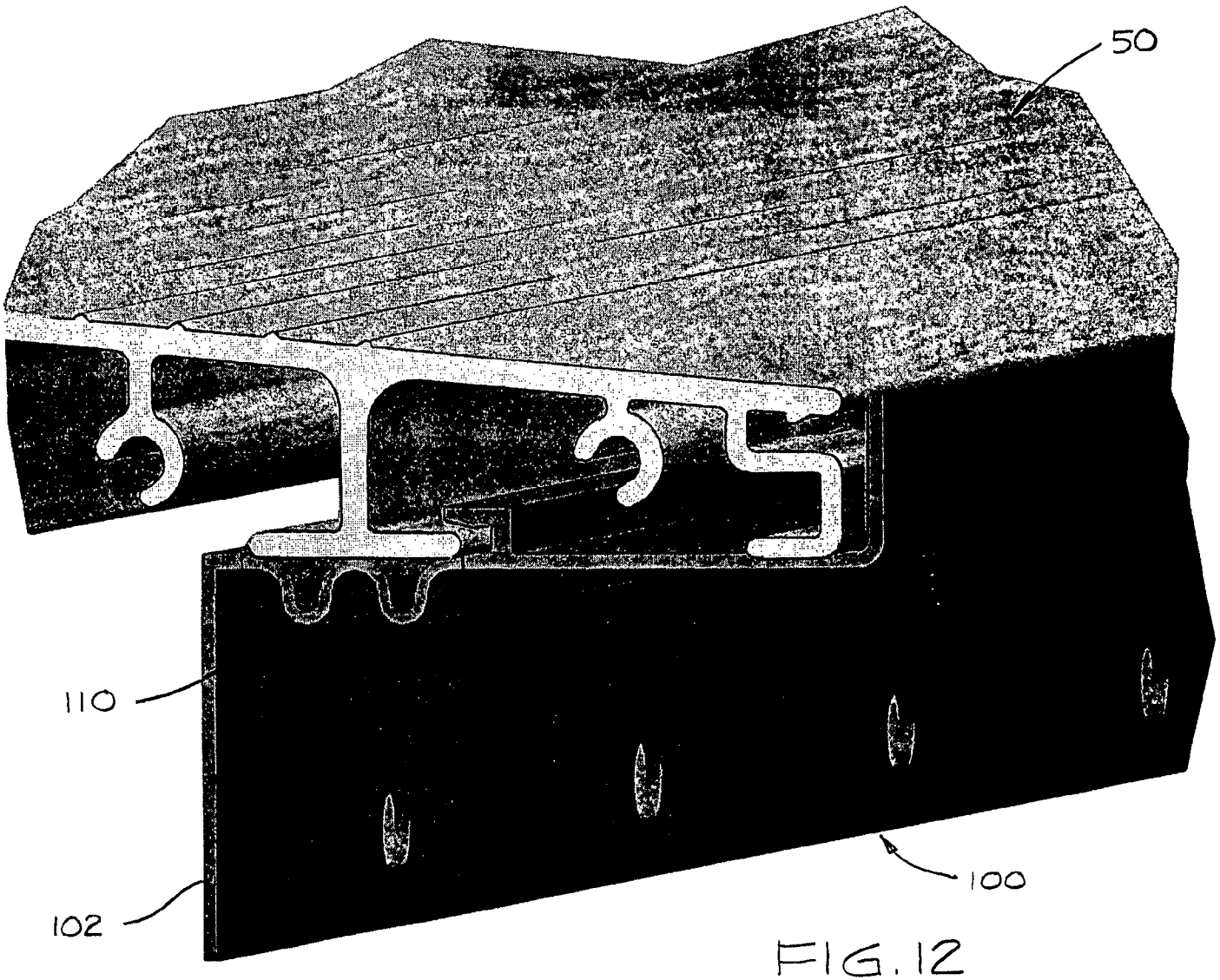
FIG. 12 is a perspective view of the sealing fin of FIG. 9 attached to a forward portion of a door sill.

As shown in FIG. 12, the sealing fin 100 preferably is constructed in a single piece. In a preferred construction, the upper panel 104, tongue 108, web 106, hook 103, and lower panel 102 are made of rigid or semi-rigid polyvinyl chloride (PVC), while the tab 107 and extendable and contractable portion 110 are made of a co-extruded, flexible PVC. The forward portion of the sealing fin 100 shown in FIGS. 9-12 is configured like the forward portion of sealing fin 60 shown in FIGS. 6-8 for use with a deep or extended sill 50 as shown in FIGS. 10-12. Alternatively, the forward portion of the sealing fin 100 can be configured like the forward portion of the sealing fin 30 shown in FIGS. 1-5 for use with a shallow door sill 20 like that shown in FIGS. 1, 2, and 5.

The invention has been described herein in terms of preferred embodiments and methodologies. It will be understood by those of ordinary skill in the art, however, that a wide variety of additions, deletions, and modifications might be made to the illustrated embodiments without departing from the spirit and scope of the invention as set forth in the claims.

What is claimed is:

1. A threshold for installation atop a sub-sill of a building wall frame, the sub-sill having a front face, and the threshold comprising:

(a) a sill frame comprising a sill deck having a forward deck portion, a bottom, and a forward edge; and (b) a sealing fin including an upwardly extending upper panel substantially covering the entire forward edge of the sill frame;

(c) wherein the forward edge of the sill frame includes a recess and the upper panel of the sealing fin includes a tongue configured to be received in the recess, and wherein the sealing fin further includes a connector configured to engage the bottom of the sill frame; and (d) wherein the sealing fin is connected to the sill frame when the tongue is received in the recess and the connector is engaged with the bottom of the sill frame.

2. A threshold according to claim 1 wherein the forward deck portion and forward edge of the sill frame are configured to overhang the front face of the sub-sill by an overhang distance when the threshold is installed in the wall frame.

3. A threshold according to claim 2 wherein the sealing fin further comprises a downwardly extending lower panel that is inwardly offset from the upper panel by an offset distance that is substantially equal to the overhang distance.

4. A threshold according to claim 3 and further comprising a web connecting the upper and lower panels.

5. A threshold according to claim 4 wherein the web of the sealing fin is connected to the lower panel by a flexible hinge portion.

6. A threshold according to claim 1 wherein the sealing fin is removably connected to the sill frame.

7. A threshold according to claim 1 wherein the connector comprises an upwardly extending catch and the sill frame further comprises a notch in the bottom of the sill frame configured to receive the catch, and wherein the sealing fin is connected to the sill frame when the catch is received in the notch and the tongue is received in the recess.

8. A threshold according to claim 1 wherein the bottom of the sill frame includes a flange and the connector comprises a hook portion, wherein the hook portion is configured to receive the flange, and wherein the sealing fin is connected to the sill frame when the flange is received in the hook portion and the tongue is received in the recess.

9. A threshold according to claim 1 wherein the sealing fin is constructed of at least one polymeric material.

10. A sealing fin for a door sill frame having a front edge and a bottom, the sealing fin comprising:

(a) an upwardly extending upper panel having a lower edge and being configured to matingly engage the front edge of the door sill frame;

(b) a substantially horizontal web rearwardly extending from the lower edge of the upper panel and having a rear edge;

(c) a lower panel downwardly extending from the rear edge of the web portion; and (d) a hinge connecting the lower panel to the web;

(e) wherein the hinge permits the lower panel to pivot between a first position and a second position;

(f) wherein the upper panel of the sealing fin includes a tongue configured to be received in a recess in the front edge of the sill frame; and (g) wherein the web includes a connector configured to at least partially connect the web to the bottom of the sill frame.

11. A sealing fin according to claim 10 wherein the front edge of the door sill frame and the lower panel of the sealing fin are located behind the front edge of the sill frame when the upper panel is engaged with the front edge of the sill frame.

12. A sealing fin according to claim 10 wherein the hinge comprises a resilient polymeric material.

13. A sealing fin according to claim 10 wherein the upper panel is configured to substantially cover the entire front edge of the door sill when the upper panel is engaged with the front edge.

14. A sealing fin according to claim 10 wherein the sill frame further includes a downwardly open notch behind its front edge, and the connector comprises an upstanding catch configured to be received in the notch.

15. A sealing fin according to claim 10 wherein the sill frame further includes a flange positioned behind its front edge, and the connector comprises a hook on the web that is configured to receive at least a portion of the flange.

16. A sealing fin according to claim 10 wherein the sealing fin substantially is constructed of at least one polymeric material.

17. An entryway comprising:

(a) a sub-sill having a top surface and a front face;

(b) a sill frame mounted atop the top surface of the sub-sill, the sill frame having a forward deck portion that overhangs the front face of the sub-sill, a front edge, and a bottom;

(c) a sealing fin having an upper panel substantially covering the entire front edge of the sill frame, a web portion rearwardly extending from the upper panel and underlying at least a portion of the bottom of the sill frame, and a lower panel downwardly extending from the web portion, wherein the lower panel is closely proximate to the front face of the sub-sill and is affixed thereto by a plurality of fasteners;

(d) wherein the sealing fin provides a substantially water-resistant barrier between the sill frame and the sub-sill;

(e) wherein the sill frame includes a recess along its front edge and the sealing fin comprises a tongue received in the recess; and (f) wherein the web portion includes a connector configured to at least partially connect the web to the bottom of the sill frame.

18. An entryway according to claim 17 wherein the sealing fin comprises at least one extruded polymeric material.

19. An entryway according to claim 17 wherein the sill frame comprises extruded aluminum and the sealing fin comprises an extruded polymeric material.

20. An entryway according to claim 17 wherein the sill frame includes an elongated notch along its bottom, and the connector comprises a tongue and an upward catch, wherein the catch is received in the notch of the sill frame, thereby at least partially removably affixing the sealing fin to the sill frame.

21. An entryway according to claim 17 wherein the sill frame further comprises a flange along its bottom, and the connector comprises a hook portion, wherein the hook portion engages the flange of the sill frame, thereby at least partially removably affixing the sealing fin to the sill frame.

22. A seal for sealing a juncture between a sub-floor having a front edge and a door sill having a bottom and a forward edge overhanging the front edge of the sub-floor by a substantial distance, the seal comprising:

(a) a one-piece moisture-resistant polymeric sealing fin having a first connecting means for connecting a front portion of the sealing fin to the forward edge of the sill, a second connecting means for connecting a rear portion of the sealing fin to the front edge of the sub-floor, and a third connecting means for at least partially connecting an intermediate portion of the sealing fin to the bottom of the sill;

(b) wherein the front portion of the sealing fin substantially covers the forward edge of the sill.

23. A seal according to claim 22 wherein the sealing fin substantially conforms to the shape of the juncture between the sub-floor and the sill.

24. A seal according to claim 22 wherein the first connecting means comprises a tongue and groove connector.

25. A seal according to claim 22 wherein the second connecting means comprises a plurality of removable fasteners.

26. A seal according to claim 22 wherein the third connecting means comprises a catch on the sealing fin that is configured to be received in a notch in the bottom of the door sill.

27. A seal according to claim 22 wherein the third connecting means comprises a hook on the sealing fin that is configured to receive a flange on the bottom of the door sill.

* * * * *

UNITED STATES PATENT AND TRADEMARK OFFICE

CERTIFICATE OF CORRECTION

PATENT NO. : 7,266,929 B1
APPLICATION NO. : 10/683027
DATED : September 11, 2007
INVENTOR(S) : Philip Allred and Bruce Procton It is certified that error appears in the above-identified patent and that said Letters Patent is hereby corrected as shown below:

In Claim 20, Column 8, line 17, the words "a tongue and" should be deleted.

Signed and Sealed this

Eleventh Day of March, 2008

JON W. DUDAS
*Director of the United States Patent and Trademark Office*